United States Patent [19]

Long

[11] 4,068,687

[45] Jan. 17, 1978

[54] VAPOR RECOVERY LIQUID DISPENSING APPARATUS

[76] Inventor: Robert A. Long, R.R. No. 2, P.O. Box 158, Friendship, Wis. 53934

[21] Appl. No.: 701,637

[22] Filed: July 1, 1976

[51] Int. Cl.[2] ..... B65B 31/00

[52] U.S. Cl. ..... 141/59; 141/206; 141/290; 141/291; 417/348

[58] Field of Search ..... 141/44, 45, 46, 52, 141/53, 54, 59, 198–229, 290, 65, 392, 291–296, 351–362; 417/348, 349; 222/484

[56] References Cited

U.S. PATENT DOCUMENTS 3,850,208 11/1974 Hamilton ..... 141/290

*Primary Examiner*—Houston S. Bell, Jr.
*Attorney, Agent, or Firm*—Harry C. Engstrom; Theodore J. Long

[57] ABSTRACT

A liquid dispensing nozzle is provided with a liquid discharge tube and a vapor recovery tube, both of which are adapted to be inserted into the fill pipe of a tank such as a motor vehicle gasoline tank. While gasoline or other volatile liquid is discharged through the discharge tube, a substantially equal volume of vapor is withdrawn through the vapor recovery tube to a pneumatic pump portion of a hydraulic motor-pneumatic pump device. Gasoline flowing through a hydraulic motor therein drives the pneumatic pump, which is operably connected to the hydraulic motor to be driven in synchrony therewith. The volume of vapor withdrawn from the fuel tank is adjusted to be approximately equal to the volume of liquid discharged, such that the pressure inside the tank is substantially atmospheric, and the end of the fill pipe of the tank may be sealed to prevent vapor from escaping or air from being drawn into the tank. The vapor recovery tube may be in communication with a vacuum chamber within the dispensing nozzle, such that blockage of the entrance end of the vapor recovery tube would result in a vacuum developed within the vacuum chamber sufficient to actuate a vacuum responsive device, which disables the manually operated lever of the dispensing nozzle.

22 Claims, 7 Drawing Figures

VAPOR RECOVERY LIQUID DISPENSING APPARATUS

BACKGROUND OF THE INVENTION

1. Field of the Invention

This invention pertains generally to the field of vapor recovery devices associated with equipment for dispensing volatile liquids, such as gasoline pumps and dispensing nozzles.

2. Description of the Prior Art

The filling of the fuel tank of an automobile or other vehicle is commonly accomplished by delivering gasoline through an operator controlled nozzle, and freely pumping the gasoline into the tank. The agitation of the volatile gasoline through the pump and nozzle, and its splashing into the tank of the vehicle, tends to generate a considerable amount of vapor which is ordinarily released to the atmosphere through the fill pipe of the tank. Moreover, as gasoline is dispensed into the fuel tank, it necessarily occupies volume in the tank which had been occupied by air containing a considerable amount of vaporized gasoline. This volume of vapor is necessarily displaced from the tank, generally through the fill pipe into the atmosphere.

The raw gasoline vapor that escapes into the atmosphere during the filling operation presents an economic loss in terms of the actual gasoline lost, and also creates an air pollution problem since the gasoline vapor will react in the atmosphere to produce pollutants. The seriousness of the problem has induced both local and federal governmental agencies to propose regulations as to the amount of gasoline vapor that may be discharged into the atmosphere during the filling operation.

Various devices are available to recapture the gasoline vapor, and either trap it for disposal or recondense the vapor to useable gasoline. The vapor in the fuel tank has typically been collected by such devices through a separate vapor recovery hose, and led back to a storage area where the vapor may be stored, or to a vapor recovery apparatus which extracts liquid gasoline from the vapor. The transport of the gasoline vapor from the fuel tank to the storage or recovery apparatus is typically accomplished either by utilizing an overpressure in the tank provided by sealing the entrance of the tank and discharging fuel thereinto, or by providing a positive vacuum to draw the fuel vapors out of the tank. The first method presents the possibility of overpressurizing and possibly bursting the fuel tank, and the second method may result in an underpressure in the tank, which could draw air into the recovery apparatus and build up an explosive gasoline-air mixture. Apparatus has been developed to control the vacuum present in the vapor recovery line, and thus minimize the possibility of an underpressure in the fuel tank, but such equipment has required the careful monitoring of the pressure and control of the vacuum pump in response to pressure in the vacuum line.

SUMMARY OF THE INVENTION

I have invented apparatus for dispensing volatile liquids such as gasoline into a fuel tank, and for recovering the vapors that are present in the tank and that may be produced during the filling operation. My apparatus is capable of delivering gasoline safely and economically, while avoiding the development of substantial over- or under-pressures within the fuel tank.

My apparatus includes a manually operable fuel dispensing nozzle which controls the volume of gasoline being discharged into the fuel tank. The dispensing nozzle includes a liquid discharge tube through which gasoline is discharged into the fuel tank, and a second vapor recovery tube, with the gasoline discharge tube in a preferred embodiment being disposed within the vapor recovery tube. The dispensing nozzle has an automatic vacuum actuated shut-off device, which is actuated when liquid in the tank reaches the level of the opening in the nozzle to disable the manual operation of the nozzle to prevent overfilling of the tank. In a preferred embodiment of my invention, the sensing of the level of liquid in the tank is accomplished by means of the vapor recovery tube itself. Vapors in the tank are drawn into the vapor recovery tube by a slight vacuum produced therein by a pneumatic pump, and thence into and through a vacuum chamber within the body of the nozzle. The apparatus is designed such that the vacuum present in the vacuum chamber will be very slight as long as the entrance end opening of the vapor recovery tube is unobstructed by liquid within the tank. However, when the liquid rises to the level of the entrance of the vapor recovery tube, the vacuum within the vacuum chamber will rapidly increase, which will actuate a vacuum responsive device within the nozzle to disable the manually operated control lever of the nozzle. The valve controlling the flow of gasoline through the nozzle, and the basic means for disabling the lever or handle of the nozzle are not critical to my invention, and standardized components to perform such functions may be utilized.

Vapors are drawn from the fuel tank through the dispensing nozzle by means of a hydraulic motor-pneumatic pump device, wherein the liquid gasoline flowing to the nozzle passes through a hydraulic motor. The flowing gasoline drives the hydraulic motor, and the motor is operably connected to a pneumatic pump which is driven in synchrony therewith, and the pump withdraws vapors from the fuel tank at a flow rate directly related to the rate of flow of gasoline into the fuel tank. The hydraulic motor and pneumatic pump are preferably of the positive displacement type such that a constant relationship is maintained between the flow of liquid into the tank and the flow of vapor out. The flow of vapor produced by the pneumatic pump may be adjusted such that the pressure within the fuel tank is approximately equal to atmospheric pressure or only slightly below atmospheric pressure. The withdrawn vapors may be directed back to the storage tank from which the liquid was removed without resulting in a substantial over- or under- pressure within the storage tank. Since the quantities of vapor withdrawn from the fuel tank are directly related to the quantity of fuel introduced into the tank, sealing means may provide a substantially air tight seal on the end of the fill pipe of the fuel tank to substantially prevent the escape of any vapors into the atmosphere during filling. Such sealing means may take the form of a flange member attached to the outside of the vapor tube which substantially closes off the end of the fill pipe when the vapor tube is inserted therein. Because the pneumatic pump is directly driven by the gasoline flow operated hydraulic motor, vapors will not be withdrawn from the fuel tank until the flow of gasoline has actually begun, and no vapors will be withdrawn when gasoline flow has stopped. A low pressure sufficient to actuate the vacuum actuated device for disabling the nozzle lever thus can only be developed after gasoline has begun to flow.

To facilitate the use of my liquid dispensing apparatus in self-service stations, and to insure that the fill pipe of the tank will be properly sealed during the filling operation, my improved dispensing nozzle is adapted, in a preferred embodiment, such that no liquid gasoline will be discharged unless the flange member mounted on the vapor recovery tube is pressed up against the end of the fill pipe. The outer vapor recovery tube is resiliently mounted to the body of the nozzle in this embodiment such that it may be moved toward the nozzle body as the flanged sealing member is pressed up against the end of the fill pipe. The displacement of the vapor recovery tube toward the nozzle body allows the alignment and communication of an opening in the vapor tube with a vapor inlet passageway in the nozzle body itself, thereby allowing vapors to be withdrawn from the fuel tank and allowing gasoline to flow through the nozzle into the tank. When the opening in the vapor tube is normally closed by the nozzle body and is not in communication with the inlet passageway, the initial flow of gasoline through the nozzle will cause a vacuum to be built up in the vacuum chamber which will result in disabling of the manually operated lever of the nozzle. This feature further insures that gasoline will not be discharged accidentally onto the ground.

Further objects, features and advantages of my invention wil be apparent from the following detailed description taken in conjunction with the accompanying drawings showing a preferred embodiment of liquid dispensing apparatus exemplifying the principles of my invention.

DESCRIPTION OF THE PREFERRED EMBODIMENT

Figure 1:
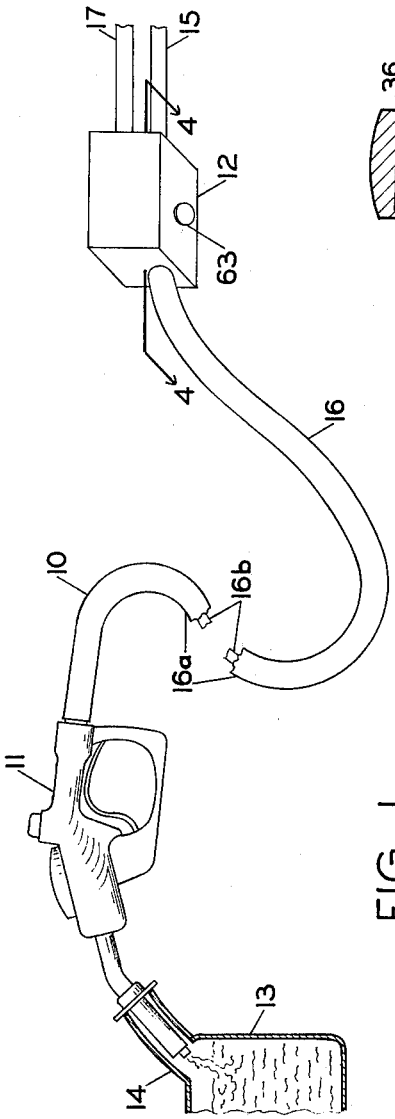
FIG. 1 is a side elevation view of my liquid dispensing apparatus with the dispensing nozzle of my apparatus shown in position to discharge liquid into a fuel tank.

Referring now more particularly to the drawings, wherein like numerals refer to like parts throughout the several views, a preferred embodiment of my vapor recovery liquid dispensing apparatus is shown generally at 10 in FIG. 1. The dispensing apparatus 10 includes a liquid dispensing nozzle 11 and a hydraulic motor-pneumatic pump device 12 which passes gasoline to the nozzle 11 and receives gasoline vapors back from the nozzle.

The liquid dispensing nozzle 11 is adapted to manually control the flow of liquid into a tank 13 having a fill pipe 14 extending therefrom into which a portion of the dispensing nozzle 11 is inserted when liquid is to be dispensed into the tank. As described above, the flow of liquid into the tank 13 results in a necessary expulsion of vapor out of the fill pipe 14 into the atmosphere where no means are provided to recover the vapor from the tank. My apparatus 10 is adapted to be used with commonly available pumping apparatus such as the usual metering pump utilized at gasoline service stations. The gasoline or other volatile liquid under pressure which is supplied by a pump (not shown) is provided to a gasoline hose 15 which leads into the hydraulic motor-pneumatic pump device 12. After passing through the device 12, the gasoline or other liquid passes through a delivery hose 16 to the dispensing nozzle 11. Gasoline vapors within the tank 13 are drawn through the nozzle 11 back through the delivery hose 16 to the motor-pump device 12 and thence out a vapor return line 17. The vapors that pass through the vapor return line 17 may be stored or recycled in accordance with any appropriate recovery technique. As explained below, the rate of flow of vapor may be adjusted such that the vapor may be returned directly to the storage tank from which the liquid was drawn without resulting in substantial over- or under- pressures in the storage tank.

Figure 2:
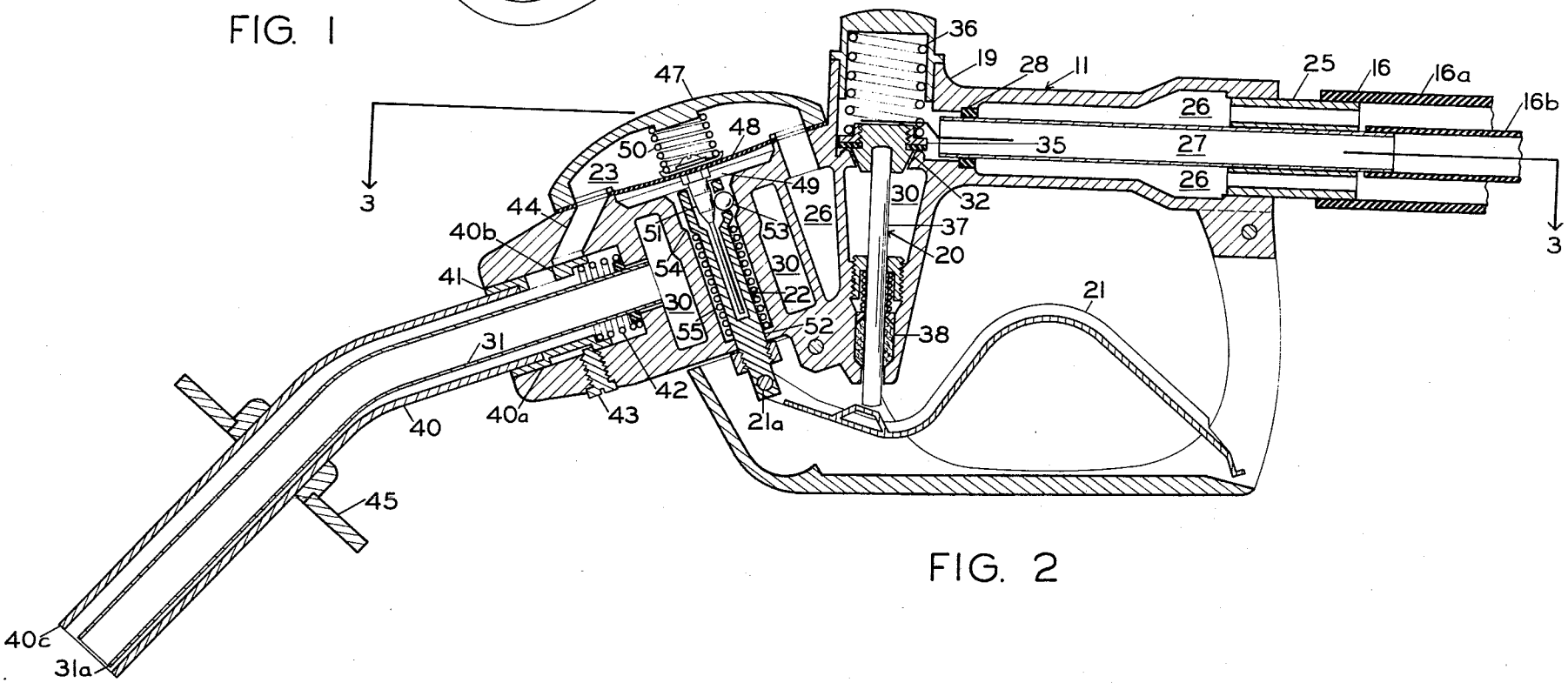
FIG. 2 is a vertical section of the dispensing nozzle portion of my apparatus of FIG. 1.

The nozzle portion 11 of my apparatus is best shown in the cross-sectional view of FIG. 2. The dispensing nozzle 11 is of substantially conventional design, having a liquid flow control valve 20 which opens to allow flow therethrough by pressure applied by a manually actuated lever 21 when the lever is manually raised by an operator. A vacuum responsive device 22 responds to pressures lower than atmospheric in a vacuum chamber 23 formed in a nozzle body 19, to disable the lever 21 and prevent it from opening the valve 20 when the level of liquid in the tank reaches the nozzle.

The delivery hose 16 may consist of a set of coaxial hoses with an outer hose **16*a* and an inner hose 16*b*, with the gasoline or other liquid being delivered to the nozzle 11 through the inner hose 16*b*, and with the vapor being retracted through the space defined between the inner hose 16*b* and the outer hose 16*a*. A coaxial hose fitting 25 joins the coaxial hose 16 to the nozzle body 19. The outer chamber of the coaxial fitting 25 is in communication with the vapor return portion of the hose 16 and with a vapor outlet passageway 26 defined within the nozzle body 19. The coaxial fitting 25 slips over a tubular portion of the body 19 which defines a liquid inlet passageway 27 within the nozzle body 19, with the inlet passageway 27 being in communication with the inner gasoline delivery hose 16*b* of the hose 16. The vapor outlet passageway 26 and the liquid inlet passageway 27 are sealed off from each other, at the end of the vapor outlet passageway, by a seal 28** formed of neoprene rubber or other material which is resistent to the gasoline or other volatile liquids being dispensed.

The control valve 20 controls the flow of liquid between the inlet passageway 27 and a liquid outlet passageway 30 formed within the nozzle body 19. As best shown in the cross-sectional view of FIG. 2, the outlet passageway 30 is in communication with a liquid discharge tube 31 which guides the liquid into the tank being filled. The liquid inlet passageway 27 and the liquid outlet passageway 30 communicate through an orifice 32 in the walls of the nozzle body which separate the liquid inlet and outlet passageways. The orifice 32 also acts as the valve seat for a poppet closure member 35 of the control valve 20. The closure member 35 is urged downwardly by a resilient spring 36 into a closed position in which it covers and closes off the orifice 32, thus normally blocking communication of the liquid inlet and outlet passageways. The closure member 35 is lifted upwardly to open the orifice by the force transmitted thereto by a valve stem 37 which is affixed to the closure member 35 at the top of the stem, and which extends downwardly through an opening in the nozzle body 19 to a position where it may be engaged and pushed upwardly by the manually operated lever 21. A packing gland 38 seals the valve stem 37 within the nozzle body 19 to prevent the leakage of liquid out of the outlet passageway 30. It is apparent that manually applied upward pressure on the lever 21 will cause the lever to rotate around its pivotal fulcrum point 21*a* to apply upward pressure to the valve stem 37 and thereby lift the closure member 35 upwardly to bring the liquid inlet and outlet passageways into communication and allow liquid to flow through the orifice 32.

Figure 7:
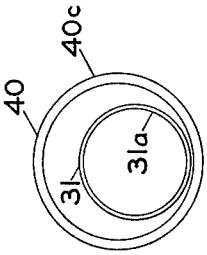
FIG. 7 is an elevation view of the discharge end of the dispensing nozzle portion of the apparatus of FIG. 1.

The vapor within the tank 13 is preferably drawn into the nozzle 11 through a vapor recovery tube 40. In the preferred embodiment shown in FIG. 2 and in the end view of FIG. 7, the liquid discharge tube is disposed within the vapor recovery tube. To facilitate withdrawal of a volume of vapor substantially equal to the volume of liquid discharged, it is preferred in this embodiment that the vapor tube have approximately twice the cross-sectional area of the discharge tube, such that the area of the liquid discharge and vapor recovery passageways will be approximately equal. It is apparent that other discharge tube configurations, such as a bifurcated tube, may also be utilized. The vapor tube 40 is preferably resiliently mounted to the nozzle body 19 and normally biased away therefrom, such that the vapor tube can move inwardly toward the nozzle body within a socket 41 in the nozzle body 19, with the vapor tube 40 being resiliently urged outwardly by a spring 42 mounted between the vapor tube and the end of the socket 41. The vapor tube 40 is prevented from exiting the socket 41 by means of a retaining screw 43 which is screwed through the end of the nozzle body to engage with the walls of a slot 40*a* in the vapor recovery tube 40, with the retaining screw 43 abutting against the ends of the slot 40*a* to limit the travel of the tube 40. The vapor tube 40 also has an opening 40*b* in the walls of the tube that adjoin the socket 41, with the opening 40*b* being positioned such that it is normally closed off by the walls of the socket when the tube 40 is in its outward extended position, and with the opening 40*b* being in communication with a vapor inlet passageway 44 in the nozzle body 19 when the vapor tube is moved inwardly toward the nozzle body. It is thus apparent that vapor can be drawn into the inlet passageway 44 only when the vapor tube 40 has been pushed inwardly. The sealing means on my vapor recovery apparatus preferably provides for this inward movement of the vapor recovery tube while sealing off the end of the tank fill pipe. With reference to FIG. 2, a substantially flat, outwardly extending flange member 45 is fixedly attached to the vapor recovery tube 40. The sealing flange 45 is preferably made of a material which will be relatively stiff but will allow itself to be pressed up to and sealingly engage the end of the fill pipe to cover the end of the fill pipe and provide a substantially air tight seal thereon, thus preventing air from being drawn in or vapors from being discharged out of the fill pipe. For example, the sealing flange member 45 may be made of a stiff, resilient rubber material, or may be constructed as a metal flange rigidly attached to the vapor tube 40 with soft oil resistent rubber being formed around the metal core of the flange. Additionally, the core of the flange may be formed of a permanently magnetized material which will magnetically be drawn to the end of a ferromagnetic fill pipe to allow the flange member 45 to remain engaged to the fill pipe with minimal operator assistance. It is apparent that pressure on the flange member 45 as the operator inserts the nozzle into the fill pipe will result in the vapor recovery tube 40 being moved inwardly toward the nozzle body. Thus, as long as the operator is pressing the flange member 45 against the end of the fill pipe, the opening 40*b* in the vapor recovery tube will align and communicate with the vapor inlet passageway 44 in the nozzle body to allow vapors to be drawn up to be drawn up through the vapor recovery tube and into the inlet passageway 44. It is also apparent that where a seal on the end of the fill pipe is not necessary, a protrusion or small flange formed on the vapor tube may be utilized to move the vapor tube toward the nozzle body during filling. Moreover, with the use of my apparatus, a permanent sealing means may be formed on the end of the fill pipe such that an air tight seal would be formed around the vapor recovery tube when it was inserted into the end of the fill pipe.

Figure 3:
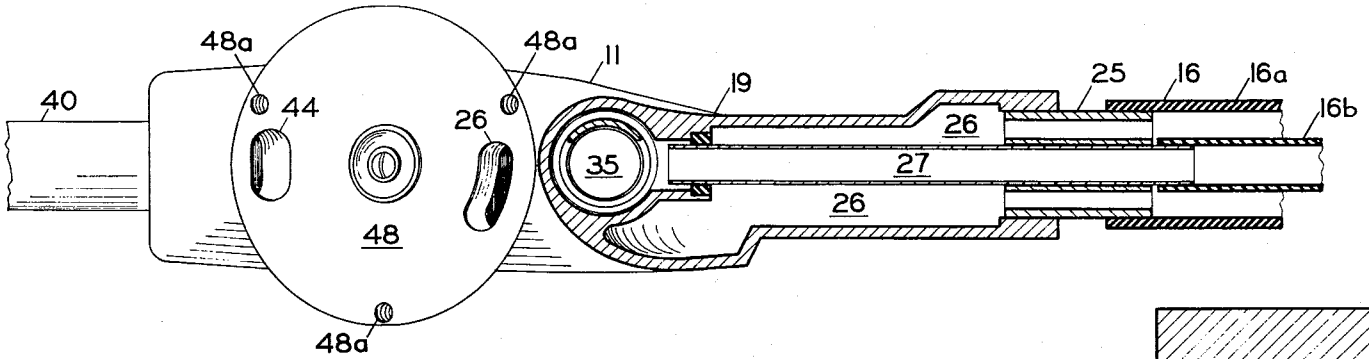
FIG. 3 is a cross-sectional view of the dispensing nozzle portion of my apparatus, taken along the line 3—3 of FIG. 2.

The vapor inlet passageway 44 is in communication at its other end with the vacuum chamber 23 within the nozzle body 19. The vaccum chamber 23 is formed between a vacuum chamber cap portion 47 of the nozzle body and a pressure sensitive diaphragm 48. The diaphragm 48 separates the vacuum chamber 23 from an air chamber 49 formed within the nozzle body 19, with the air chamber 49 being maintained essentially at ambient atmospheric pressure. The diaphragm 48 forms a portion of the vacuum responsive device 22, and is preferably biased downwardly by a biasing spring 50 which is mounted between the cap 47 and the diaphragm 48. As shown in FIG. 3, openings 48*a* are provided in the diaphragm to allow screws (not shown) to be inserted therethrough for mounting of the cap 47 to the nozzle body. The vacuum responsive device 22 has a tapered pin 51 which is mounted to the underside of the diaphragm member 48. The pin 51 fits within a central opening in a plunger 52, with the plunger itself being movable within a channel in the nozzle body 19. The lower end of the plunger 52 is pivotally attached to the lever 21 at the fulcrum point 21*a* thereof. Thus, the lever 21 can be moved upwardly around the fulcrum point 21*a* only as long as the plunger 52 remains in its upward position within its channel in the nozzle body. A plurality of retainer balls 53 are fitted within pockets in the plunger 52 and abut with the tapered pin 51, a shoulder 54 in the channel in the nozzle body, and an upper portion of the plunger 52 when the plunger is in its inward position to thereby normally fixedly hold the plunger and prevent the plunger from being moved downwardly. A selected low pressure, or pressure below atmospheric, within the vacuum chamber 23 will cause the diaphragm 48 to be drawn upwardly, drawing the tapered pin 51 along with it, thereby allowing the retainer balls 53 to move inwardly out of engagement with the shoulder 54 and releasing the plunger 52 to drop downwardly to disable the lever 21 such that the lever cannot apply pressure to and open the valve 20. A plunger return spring 55 is provided to resiliently return the plunger to its upward position when the lever 21 has been released.

As shown in FIG. 2, the vacuum chamber 23 is also in communication with the vapor outlet passageway 26 within the nozzle body. Vapors that are drawn into the vapor tube 40 will be drawn through the vapor inlet passageway 44, through the vacuum chamber 23 into the vapor outlet passageway 26, and thence to the vapor return hose 16*a*.

As long as the vapor entrance end opening 40*c* of the vapor recovery tube 40 is unobstructed by liquid, vapor may be withdrawn through the vapor recovery tube through the nozzle 11 to the vapor return hose 16*a* with only a very slight vacuum required in the vapor outlet passageway 26. However, when the level of liquid in the tank 13 rises above the exit end of the liquid discharge tube to substantially obstruct the entrance end opening 40*c* of the vapor tube 40, the passage of vapor through the tube 40 will be obstructed and a vacuum will tend to be developed in the vacuum chamber 23, thereby raising the diaphragm 48 and causing the vacuum responsive device 22 to disable the lever 21.

It is preferable that the vapor entrance end opening 40*c* of the vapor recovery tube 40 be in approximate alignment with the liquid discharge end opening 31*a* of the discharge tube 31 when the vapor tube is in its outwardmost position with respect to the nozzle body 19. When the sealing member 45 is pressed against the end of the tank fill pipe 14, the vapor recovery tube 40 will thus be pushed back with respect to the liquid discharge tube 31, and the discharge end 31*a* of the discharge tube will extend beyond the vapor entrance end 40*c* of the vapor tube 40. The nonalignment of the ends of the vapor tube and the liquid discharge tube during the filling operation are desirable since it restricts the inadvertent withdrawal of liquid through the vapor recovery tube during filling, and also requires that the liquid level in the tank extend above the exit end opening 31*a* of the discharge tube before the lever 21 will be disabled and the valve 20 closed.

Figure 5:
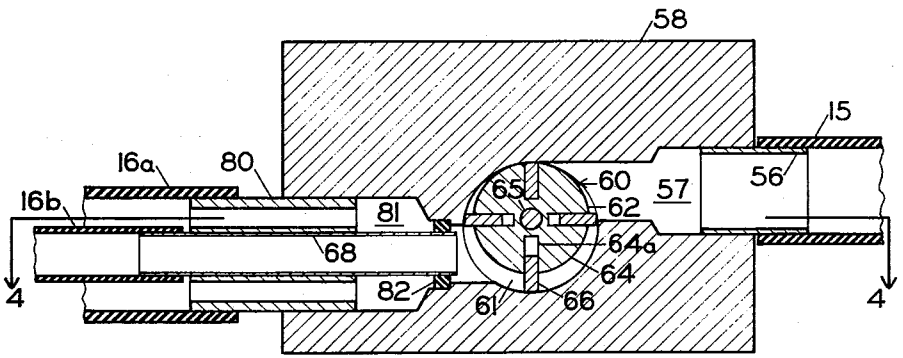
FIG. 5 is a cross-sectional view of the hydraulic motor-pneumatic pump portion of my apparatus taken along the line 5—5 of FIG. 4.
Figure 4:
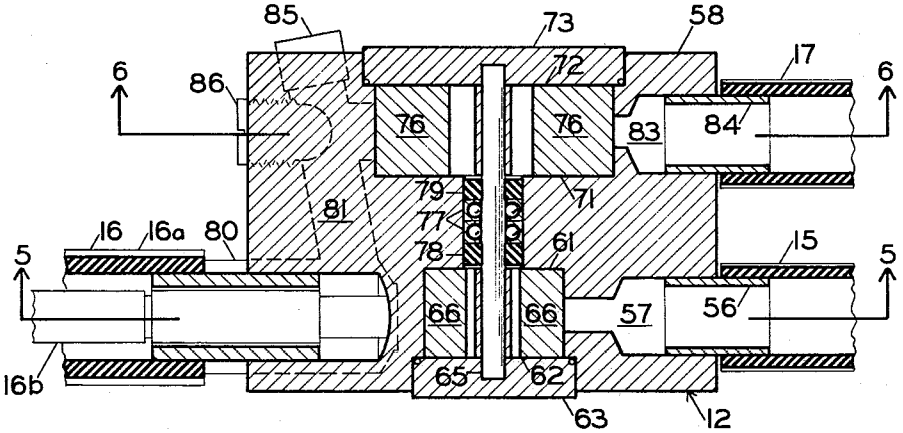
FIG. 4 is a cross-sectional view of the hydraulic motor-pneumatic pump portion of the apparatus of FIG. 1, taken along the line 4—4 of FIG. 1.

Vapor is drawn from the liquid dispensing nozzle 11 by the hydraulic motor-pneumatic pump device 12. The operation of the motor-pump device 12 is best shown with reference to the cross-sectional view of FIG. 4. The plane of the view of FIG. 4 is also illustrated by the section lines labeled 4—4 in FIGS. 5 and 6. Liquid, such as gasoline, enters the motor-pump device from the liquid supply line 15 through tubular fitting 56 to a liquid inlet port 57 formed in a solid corrosion resistent metal body 58 of the motor-pump device 12. From the inlet port 57, the flowing liquid passes into a hydraulic motor 60 which is driven by the force of the flowing liquid. The type of hydraulic motor utilized in our apparatus is not critical, however, it is desirable that the hydraulic motor utilized be of the positive displacement type and allow relatively smooth and continuous flow therethrough. A preferred embodiment of such a hydraulic motor is shown in the cross-sectional view of FIG. 4, in which the hydraulic motor 60 is formed by a motor cavity 61 within the body 58 with a sliding vane rotor 62 rotatable therein. The rotor 62 is held within the cavity 61 by an end cap 63 which may be threadingly engaged to the motor-pump body 58. As best shown in the side cross-sectional view of FIG. 5, the rotor 62 consists of a cylindrical core 64 which is eccentrically mounted on a shaft 65 for rotation within the motor cavity 61. The cylindrical core 64 has a plurality of slots 64*a* cut therein into which sliding vane members 66 are fitted. The vane members 66 may be freely fitted within the slot 64*a*, with the vanes 66 being held against the walls of the cavity 61 by centrifugal force as the rotor 62 rotates. The vane members 66 may also be spring mounted within the slot 64*a* or otherwise forced outwardly into engagement with the walls. The liquid that has passed through the hydraulic motor 60 passes into a liquid outlet port 68, and thence to the gasoline delivery hose 16*b*.

The hydraulic motor 60 is directly connected mechanically by the shaft 65 to a pneumatic pump 70 which is driven in synchrony with the motor. The pneumatic pump 70 preferably is also of the positive displacement type, and may also be a sliding vane type pump similar to the hydraulic motor 60. In the embodiment shown in FIG. 4, the pneumatic pump 70 has a pump cavity 71 in the body 58, and a sliding vane rotor which is mounted for rotation to the shaft 65 within the cavity 71. The cavity 71 may be sealed and the rotor 72 maintained therein by an end cap 73 which may be threadingly engaged to the motor-pump body 58, as illustratively shown in FIG. 4.

Figure 6:
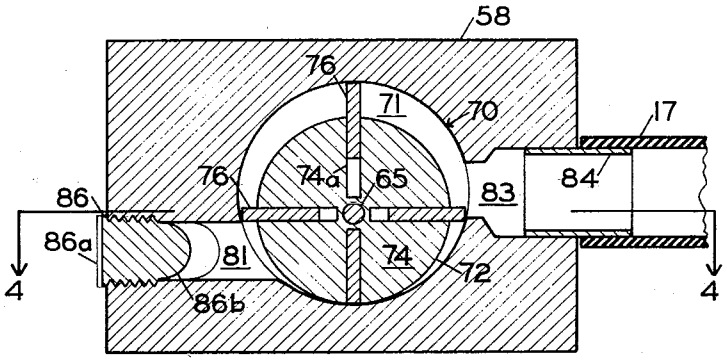
FIG. 6 is a cross-sectional view of the hydraulic motor-pneumatic pump portion of my apparatus taken along the line 6—6 of FIG. 4.

As best shown in FIG. 6, the rotor 72 has a cylindrical core 74 which is eccentrically mounted on the shaft 65 within the cavity 71, and has a plurality of slots 74*a* formed therein into which sliding vane members 76 are fitted. Since the rotor 62 of the motor and the rotor 72 of the pump are both fixedly mounted to the shaft 65, both rotors will turn synchronously and it is apparent that the volume displacement of vapor per revolution of the pump 70 may be selected to be a constant proportion, preferably at least as great, as the volume displacement of liquid per revolution of the motor 60. Generally, it is desirable to have the displacement of the pump 70 be greater than that of the motor 60 to account for leakage of air into the system, and to produce a slight vacuum in the vapor passageways which is capable of operating the vacuum actuated nozzle 11. As shown in FIG. 4, the shaft 65 is mounted for rotation on bearings 77 which are themselves mounted to the motor-pump body 58, with the bearings 77 being sealed off from the motor 60 by a bearing seal 78 and from the pump 70 with a similar seal 79.

Vapors flowing through the vapor return hose 16*a* pass through a coaxial fitting 80 and thence to a vapor inlet port 81 formed in the motor-pump body 58. The lateral position of the inlet port 81 is shown in dashed lines in FIG. 4, since the port 81 is located in the body 58 below the level of the section shown in FIG. 4. The vapors in the port 81 are sealed off from the liquid flowing through the motor 60 by a seal 82 formed of neoprene or other resistent sealing material. The vapors in the port 81 thence flow to the pneumatic pump 70, with the rotation of the rotor 72 of the pump 70 drawing the vapors through the pump and forcing the vapors out through a vapor outlet port 83 formed in the body 58, through a fitting 84, to the vapor line 17. The vapor inlet port 81 is closed off by a cap 85 which threadingly engages into the motor-pump body 58, and the passage of vapor through the passageway 81 is restricted by an adjustable restriction valve 86. The valve closure member 86*a* threads into an opening in the motor-pump body 58 with a rounded portion 86*b* of the valve closure member protruding partially into the passageway 81 an adjustable distance. The valve 86 provides a means for controlling the flow of vapor through the pump 70 such that the vapor passageways of the nozzle will be at a pressure only slightly lower than atmospheric so that the volume of vapor recovered will be substantially equal to the volume of liquid discharged. By utilizing a pump 70 which has a greater displacement than the motor 60 while rotating at the same speed, and in association with the valve 86, it is possible to adapt our apparatus for varying lengths of delivery hose and other conditions such that the pressure in the vapor passageways of the nozzle 11 will be at a desired level.

It is apparent that modifications of my apparatus 10 may be utilized without departing from the essential concept of my invention. For example, separate vapor return and liquid discharge tubes could be utilized on the nozzle 11, with the vapor recovery tube bypassing entirely the nozzle and directly the vapors directly to the motor-pump device 12. The dispensing nozzle 11 would then preferably be of any of the well known automatic shut-off type gasoline dispensing nozzles. As indicated above, it is not necessary that the hydraulic motor and pneumatic pump of my invention be of the moving or sliding vane type, but it is preferred that both the motor and pump be of the positive displacement type and that the pneumatic pump be connected to the hydraulic motor so as to operate in synchrony therewith. My apparatus 10 does not require any particular type of vapor liquification or recovery apparatus, and the vapor that is delivered through the line 17 may be disposed of in any desired manner.

It is understood that my invention is not confined to the particular construction and arrangement of parts herein illustrated and described, but embraces all such modified forms thereof as may come within the scope of the following claims.

I claim:

1. A liquid dispensing vapor recovery nozzle adapted for use with a vapor recovery vacuum pump which provides a source of vacuum, comprising:

a. a nozzle body having therein a vacuum chamber, a vapor inlet passageway in communication with said vacuum chamber, a vapor outlet passageway in communication with said vacuum chamber and said vapor inlet passageway, a liquid inlet passageway, and a liquid outlet passageway, said vapor inlet and outlet passageways being sealed off from said liquid inlet and outlet passageways to thereby prevent mixing of vapor with liquid flowing in said liquid inlet and outlet passageways, and wherein said vapor outlet passagway provides an outlet from said nozzle body which is adapted to be connected to a source of vacuum to thereby draw vapors through said vapor inlet and outlet passageways to discharge the vapor from said nozzle body to the source of vacuum;

b. a flow control valve normally blocking communication of said liquid inlet and outlet passageways;

c. a manually actuated lever adapted to open said flow control valve when said lever is manually operated and provide communication of said liquid inlet and outlet passageways;

d. a liquid discharge tube in communication with said liquid outlet passageway and having a liquid exit end opening through which liquid is discharged;

e. a vapor recovery tube which is in communication with said vapor inlet passageway and having a vapor entrance end opening through which vapor is received; and f. vacuum actuated means responsive to lower than atmospheric pressure in said vacuum chamber and operably connected to said lever for disabling said lever in response to a selected low pressure in said vacuum chamber to prevent said lever from opening said flow control valve whereby, when vapors are being withdrawn from said vapor outlet passageway by a source of vacuum, a low pressure will be developed in said vacuum chamber sufficient to actuate said vacuum actuated means when said entrance end opening of said vapor recovery tube is substantially obstructed by liquid to prevent withdrawal of liquid through said vapor recovery tube.

2. The liquid dispensing nozzle of claim 1 including sealing means for providing a substantially air tight seal on the end of a tank fill pipe into which said liquid discharge tube and said vapor recovery tube have been inserted.

3. The liquid dispensing nozzle of claim 1 wherein said liquid discharge tube and said vapor recovery tube are circular in cross section, and said liquid discharge tube is disposed within said vapor recovery tube.

4. The liquid dispensing nozzle of claim 3 wherein said vapor tube has approximately twice the cross sectional area of said liquid discharge tube.

5. The liquid dispensing nozzle of claim 3 wherein said vapor recovery tube is resiliently mounted to said nozzle body and normally biased away from said nozzle body, and wherein said vapor tube has an opening therein that is normally closed by said nozzle body, said opening in said vapor tube positioned to be in communication with said vapor inlet passageway when said vapor tube is moved toward said nozzle body to thereby allow vapor to be withdrawn from said nozzle through said vacuum chamber such that said vacuum actuated means does not disable the manual operation of said nozzle lever when the flow of vapor into said vapor recovery tube is not interfered with.

6. The liquid dispensing nozzle of claim 5 including a flange member affixed to said vapor tube and adapted to cover and provide a substantially air tight seal on the end of a tank fill pipe when pressed against the same, whereby pressing of said flange against the end of the fill pipe moves said vapor tube toward said nozzle body to bring said opening in said vapor tube into communication with said vapor inlet passageway.

7. The liquid dispensing nozzle of claim 5 wherein the exit end of said liqud discharge tube extends beyond the vapor entrance end of said vapor recovery tube when said vapor tube is moved toward said nozzle body to thereby restrict the inadvertent withdrawal of liquid through said vapor tube during filling of a tank.

8. The liquid dispensing nozzle of claim 1 wherein said nozzle body has an orifice therein between said fluid inlet and outlet passageways, and wherein said flow control valve includes a valve closure member adapted to cover and close said orifice between said liquid inlet and outlet passageways, a valve stem attached to said closure member in position to lift said valve member to open said orifice, means for resiliently urging said closure member to a position normally covering and closing said orifice, and wherein said lever is adapted to apply pressure to said valve stem to force said valve closure member to a position opening said orifice when said lever is manually operated.

9. The liquid dispensing apparatus of claim 1 wherein said vacuum actuated means includes a plunger pivotally attached to said lever at a point acting as the fulcrum point of said lever, and wherein said vacuum actuated means normally fixedly holds said plunger to allow said lever to be moved around said fulcrum point and releases said plunger to disable said lever in response to a selected low pressure in said vacuum chamber.

10. Apparatus for dispensing liquid to the fill pipe of a tank and recovering vapors from the tank, comprising:

a. a liquid dispensing nozzle having:

1. a nozzle body having therein a vacuum chamber, a vapor inlet passageway in communication with said vacuum chamber, a vapor outlet passageway in communication with said vacuum chamber and said vapor inlet passageway, a liquid inlet passage, and a liquid outlet passageway, said vapor inlet and outlet passageways being sealed off from said liquid inlet and outlet passageways to thereby prevent mixing of vapor with liquid flowing in said liquid inlet and outlet passageways, and wherein said vapor outlet passageway provides an outlet from said nozzle body which is adapted to be connected to a source of vacuum to thereby draw vapors through said vapor inlet and outlet passageways to discharge the vapor from said nozzle body to the source of vacuum;
2. a flow control valve normally blocking communication of said liquid inlet and outlet passageways,
3. a manually actuated lever adapted to open said flow control valve when said lever is manually operated and provide communication of said liquid inlet and outlet passageways,
4. a liquid discharge tube in communication with said liquid outlet passageway and having a liquid exit end opening through which liquid is discharged,
5. a vapor recovery tube which is in communication with said vapor inlet passageway and having a vapor entrance end opening through which vapor is received, and
6. vacuum actuated means responsive to lower than atmospheric pressure in said vacuum chamber and operably connected to said lever for disabling said lever in response to a selected low pressure in said vacuum chamber to prevent said lever from opening said flow control valve, whereby, when vapors are being withdrawn from said vapor outlet passageway by a source of vacuum, a low pressure will be developed in said vacuum chamber sufficient to actuate said vacuum actuated means when said entrance end opening of said vapor recovery tube is substantially obstructed by liquid to prevent withdrawal of liquid through said vapor recovery tube;

b. a positive displacement hydraulic motor adapted to receive liquid flowing under pressure and operably connected to the liquid inlet passageway of said liquid dispensing nozzle to provide the liquid flowing therethrough to said inlet passageway, said hydraulic motor being driven by the flow of liquid therethrough; and c. a positive displacement pneumatic pump operably connected to said hydraulic motor to be driven in synchrony therewith, said pneumatic pump having an inlet port and outlet port, said inlet port being pneumatically connected to said vapor outlet passageway to draw vapors therefrom when said pump is being driven by said hydraulic motor.

11. The apparatus of claim 10 including sealing means for providing a substantially air-tight seal at the opening of the tank fill pipe when said liquid discharge tube and said vapor recovery tube have been inserted into the fill pipe.

12. The apparatus of claim 10 wherein said vapor recovery tube and said liquid discharge tube are adapted to be inserted together into the fill pipe of a tank.

13. The apparatus of claim 12 wherein said liquid discharge tube and said vapor recovery tube are both circular in cross section and said liquid discharge tube is disposed within said vapor tube.

14. The apparatus of claim 13 wherein said vapor tube has approximately twice the cross-sectional area of said liquid discharge tube.

15. The apparatus of claim 13 including a flange member affixed to said vapor recovery tube and adapted to cover and provide a substantially air-tight seal at the end of a tank fill pipe when pressed against the same.

16. The apparatus of claim 10 wherein said hydraulic motor has a sliding vane rotor and said pneumatic pump has a sliding vane rotor, said rotors being mechanically connected to rotate in synchrony, and wherein the volume of vapor displaced per revolution of said vane pump rotor is at least as great as the volume of liquid which is displaced per revolution of said motor vane rotor.

17. The apparatus of claim 10 including restrictor valve means for selectively restricting the flow of vapor to said pneumatic pump to thereby selectively control the flow of vapor into the vapor entrance opening of said vapor recovery tube.

18. The apparatus of claim 10 wherein said liquid discharge tube and said vapor recovery tube are circular in cross section and said liquid discharge tube is disposed within said vapor tube, and wherein said vapor tube is resiliently mounted to said nozzle body and normally biased away from said nozzle body, and wherein said vapor tube has an opening therein that is normally closed by said nozzle body, said opening being positioned to be in communication with said vapor inlet passageway when said vapor tube is moved toward said nozzle body to thereby allow vapor to be withdrawn from said nozzle through said vacuum chamber such that said vacuum actuated means does not disable the manual operation of said nozzle lever when the flow of vapor into said vapor recovery tube is not obstructed.

19. The apparatus of claim 18 including a flange member affixed to said vapor tube and adapted to cover and provide a substantially air tight seal on the end of a tank fill pipe when pressed against the same, whereby pressing of said flange against the end of the fill pipe moves said vapor recovery tube toward said nozzle body to bring said opening in said vapor tube into communication with said vapor inlet passageway.

20. The liquid dispensing apparatus of claim 18 wherein the exit end opening of said liquid discharge tube extends beyond the vapor entrance end opening of said vapor recovery tube when said vapor tube is moved toward said nozzle body to thereby restrict the inadvertent withdrawal of liquid through said vapor tube during filling of a tank.

21. The apparatus of claim 10 wherein said valve includes a valve closure member adapted to cover and close said orifice between said liquid and outlet passageways, a valve stem attached to said closure member in position to lift said closure member to open said orifice, means for resiliently urging said closure member to a position normally covering and closing said orifice, and wherein said lever is adapted to apply pressure to said valve stem to force said closure member to a position opening said orifice when said lever is manually operated.

22. The apparatus of claim 10 wherein said vacuum actuated means includes a plunger pivotally attached to said lever at a point acting as the fulcrum point of said lever, and wherein said vacuum actuated means normally fixedly holds said plunger to allow said lever to be moved around said fulcrum point and releases said plunger to disable said lever in response to a selected low pressure in said vacuum chamber.

* * * * *